United States Patent [19]

Goyvaerts

[11] 4,061,091

[45] Dec. 6, 1977

[54] EXTENSIBLE TABLE

[75] Inventor: Edward C. Goyvaerts, Wilrijk, Belgium

[73] Assignee: N. V. Joseph Mertens International, Mortsel, Belgium

[21] Appl. No.: 733,281

[22] Filed: Oct. 18, 1976

[30] Foreign Application Priority Data

Nov. 10, 1975 Belgium ..... 254651

[51] Int. Cl.[2] ..... A47B 1/02

[52] U.S. Cl. ..... 108/84

[58] Field of Search ..... 108/84, 85, 86

[56] References Cited

U.S. PATENT DOCUMENTS

| | | | |
|---|---|---|---|
| 1,464,409 | 8/1923 | Cooklin | 108/85 |
| 1,751,831 | 3/1930 | McNulty | 108/85 |
| 1,778,666 | 10/1930 | Fox | 108/85 |
| 1,781,043 | 11/1930 | Angert | 108/85 |
| 1,836,404 | 12/1931 | Segal | 108/85 |
| 1,862,113 | 6/1932 | Dreckschmidt | 108/85 |

*Primary Examiner*—Francis K. Zugel

*Attorney, Agent, or Firm*—Bacon & Thomas

[57] ABSTRACT

The invention pertains to an extensible table, characterized by the fact that it consists of at least one sliding-out table top and at least one extension, whereby the latter is located, in position of rest, under the slidable table top or tops, and whereby said extension can cooperate, by means of outwardly directed protrusions, with vertical slots in each of the adjacent side members of the table frame, and whereby means are provided within said side members which permit, after sliding out the table top or tops, to maintain said extension in a raised position, on the one hand, and to let down again said extension for shortening the table, on the other hand.

1 Claim, 17 Drawing Figures

EXTENSIBLE TABLE

The present invention is concerned with an extensible table, more particularly a table which is provided with an extension, whereby the latter can be placed and maintained in an extremely simple manner either in the plane of the table or under the plane of the table in order respectively to lengthen or to shorten the table.

More particularly, although by no means restrictively, the present invention is concerned with an extensible table which is equipped with a top of glass.

This extensible table consists mainly of at least one table top which can be slid-out and at least one extension, whereby the latter fits under the slidable table top or tops in its position of rest and whereby this extension is capable of cooperating, by means of outwardly directed protrusions, with vertical slots in each of the adjacent side members of the table frame, and whereby means are provided in said side members, to maintain said extension, after sliding out the table top or tops, in its raised position, on the one hand, and to lower said extension for the purpose of shortening the table, on the other hand.

In order to make known more clearly the particular characteristics of the extensible table according to the invention, a preferred form of embodiment will hereinafter be described, as an example rather than a limitation, with reference to the appended drawings in which.

Figures 1, 7, 9, 13, 15:
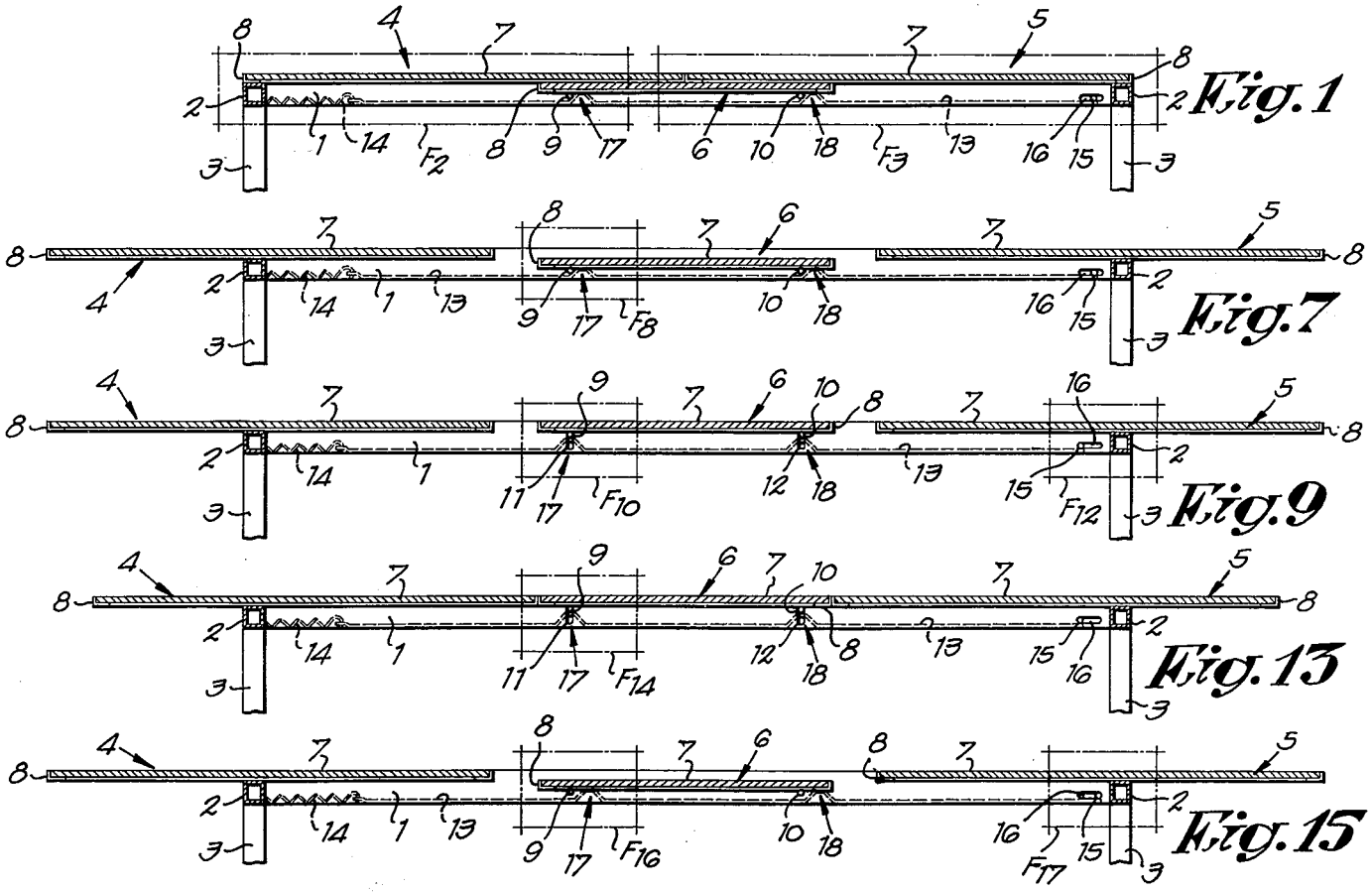
FIG. 1 shows a schematic longitudinal section of a table according to the invention, wherein the table is shown in its position of normal use.
FIG. 7 is a similar view to that of FIG. 1, but with the halves of the table top slid outward.
FIG. 9 is a similar view to that of FIG. 7, whereby however the extension has been brought up to the plane of the half table tops.
FIG. 13 is a similar view to that of FIG. 9, but however after the half table tops have been slid back against the extension.
FIG. 15 is a similar view to that of FIG. 13, however after the half table tops have been slid outwards and the extension has again been lowered.
Figure 2:
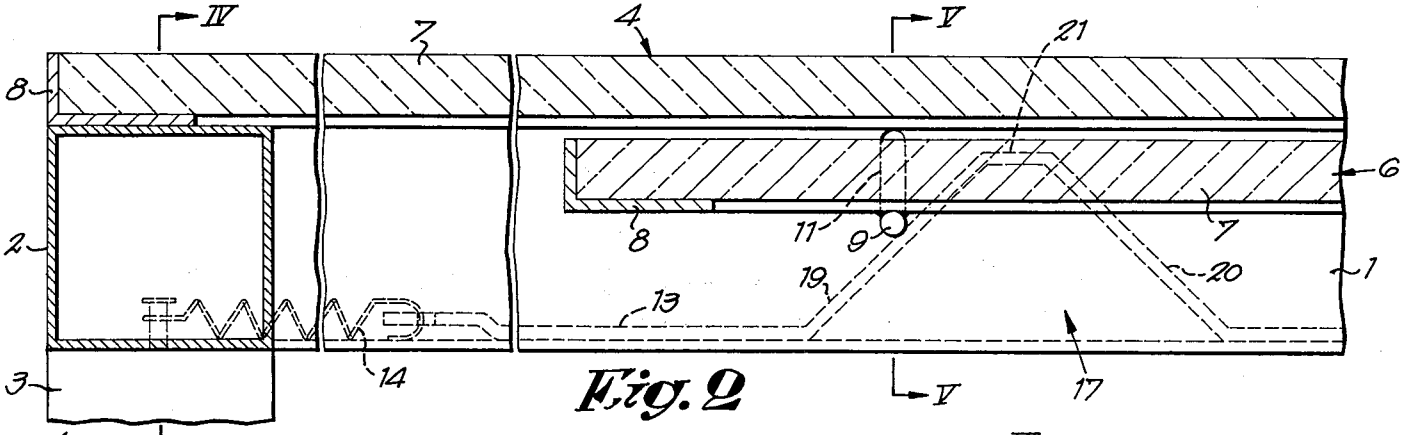
FIGS. 2 and 3 show, to a larger scale, those parts respectively indicated in FIG. 1 by F2 and F3.
Figure 3:
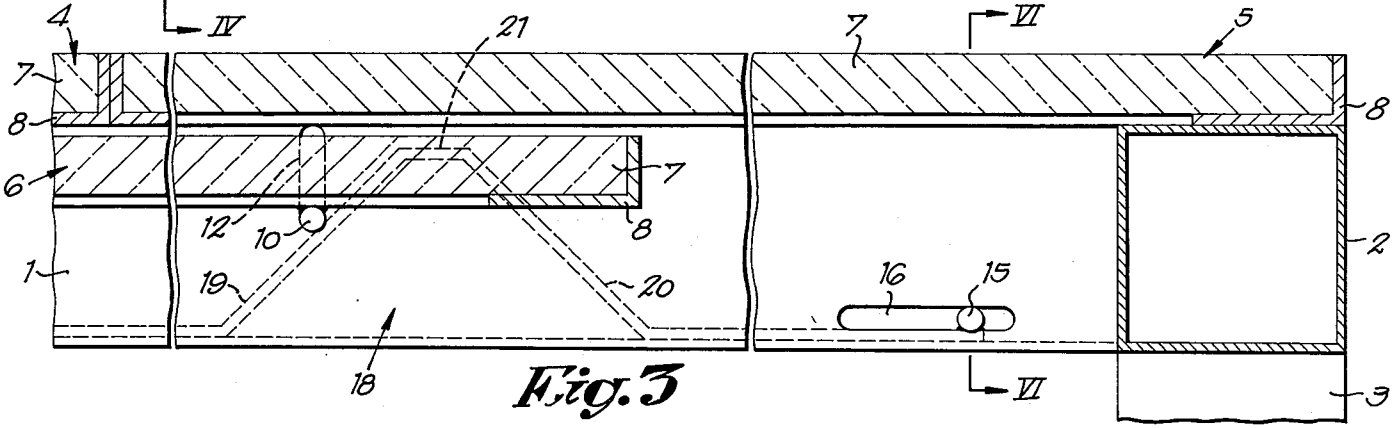
Figure 4:
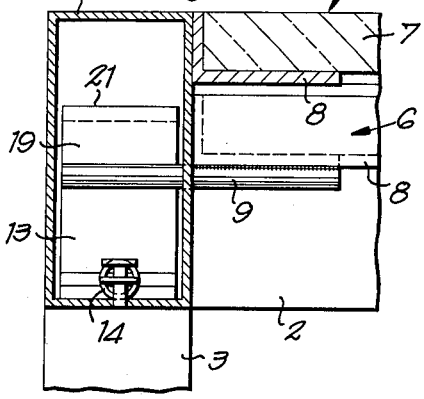
FIGS. 4 and 5 are cross-sections according to lines IV—IV and V—V in FIG. 2.
Figure 5:
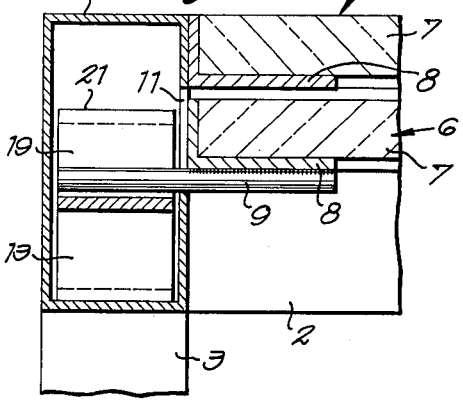
Figure 6:
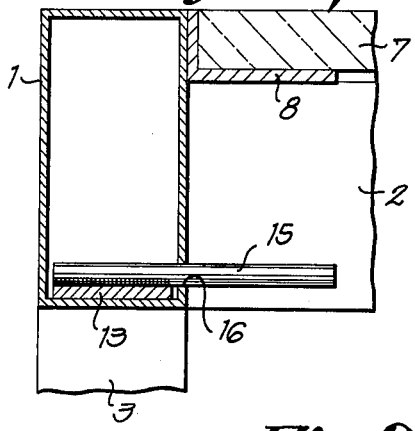
FIG. 6 is a cross-section according to line VI—VI in FIG. 3.
Figure 11:
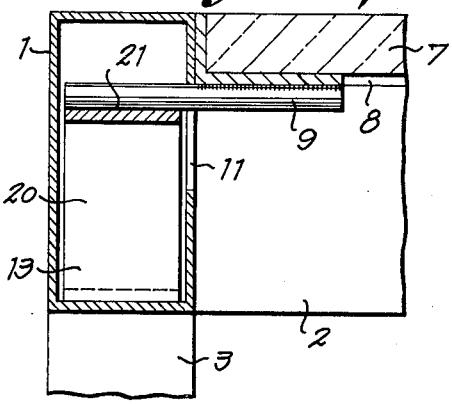
FIG. 11 is a cross-section according to line XI—XI in FIG. 10.
Figure 8:
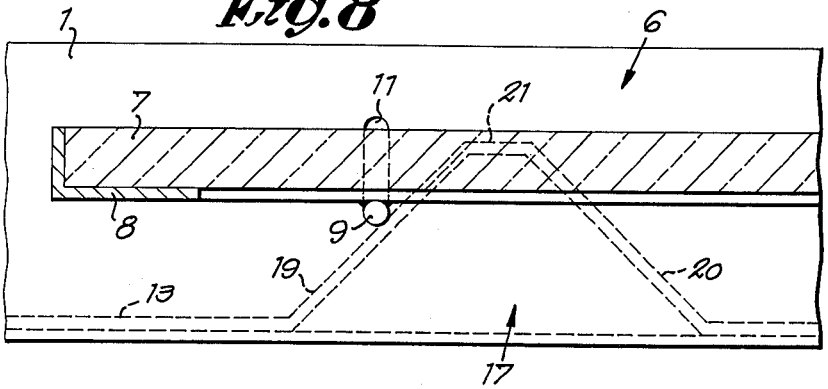
FIG. 8 shows, to a larger scale, that part of FIG. 7 which is indicated by F8.
Figure 10:
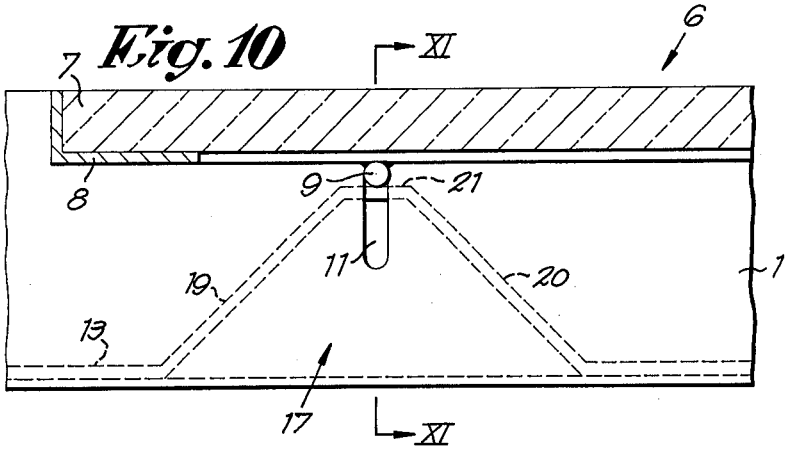
FIG. 10 shows, to a larger scale, that part of FIG. 9 which is indicated by F10.
Figure 14:
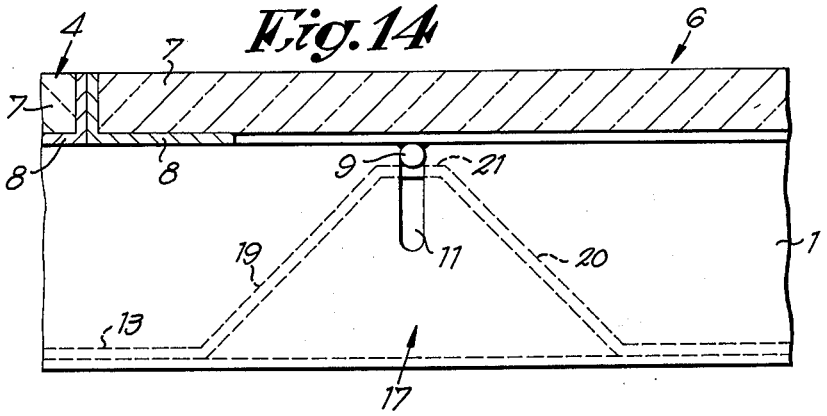
FIG. 14 shows, to a larger scale, that part of FIG. 13 which is indicated by F14.
Figure 16:
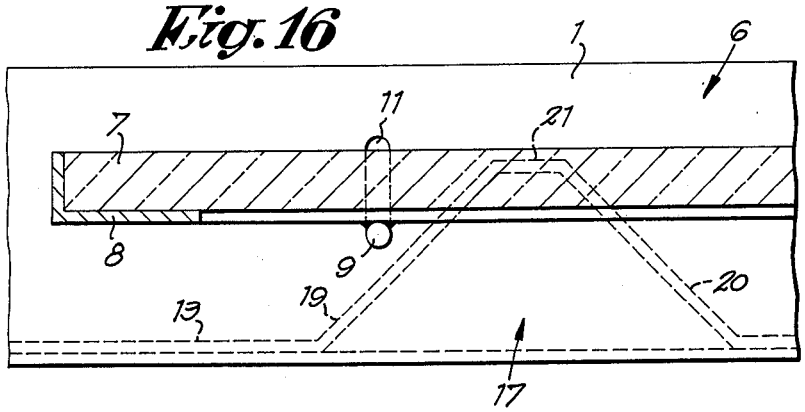
FIGS. 16 and 17 show, to a larger scale, those parts in FIG. 15 which are indicated by F16 and F17.
Figure 12:
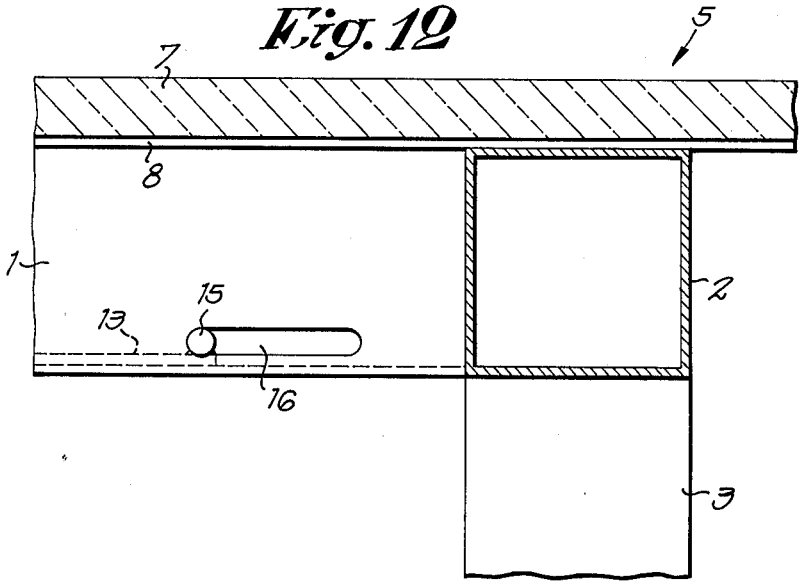
FIG. 12 shows, to a larger scale, that part of FIG. 9 which is indicated by F12.
Figure 17:
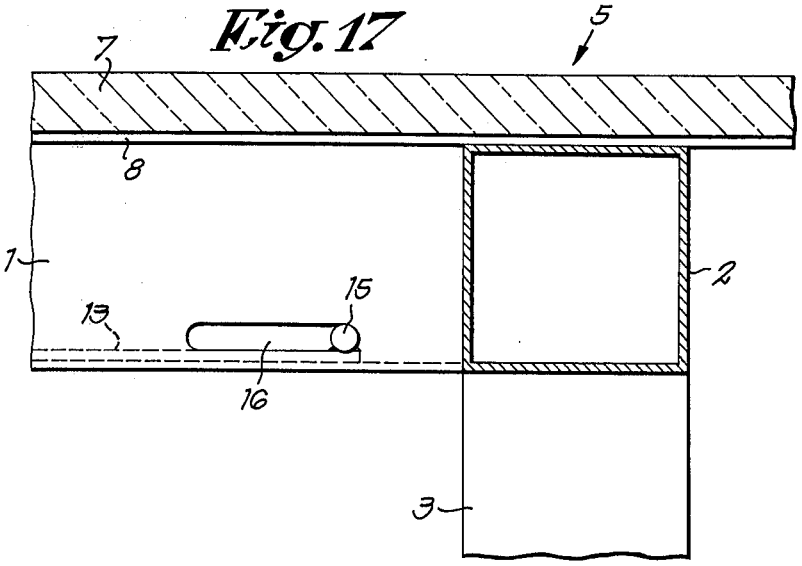

In this form of embodiment, the table according to the invention is mainly made up of a frame consisting of side member 1 and cross-members 2 which rest upon legs 3. In this frame, two half table tops are provided, respectively 4 and 5, which are fitted in an appropriate manner, by means of slides or suchlike which are not shown, so as to be able to slide between side members 1. An extension 6 is also provided, which in the position of normal use of the table is located under table tops 4 and 5, as shown in FIG. 1.

The half table tops 4 and 5, as well as the extension 6, in this case each consist of a sheet of glass 7 which is appropriately fitted in a frame 8 built of angle sections, whereby the thickness of the glass sheet 7 is equal to the width of the raised flange of the angle sections used for aforesaid frames 8.

Just as is the case of the half table tops 4 and 5, the width of extension 6 is such as to fit precisely between aforesaid members 1 in order to obtain a clearance nil, or practically nil, between side members 1 and table tops 4, 5 and extension 6.

According to the invention, extension 6 is provided on each side with protrusions, respectively 9 and 10, which cooperate with vertical slots, respectively 11 and 12, provided in the side members concerned. In this manner a suspension of extension 6 within the frame of the table is obtained, whereby said extension 6 is capable of a vertical displacement.

Further according to the invention, a lath or slide 13 is provided in each side member 1, whereby said lath is attached at one end to pull spring 14, the other end of which is appropriately fixed to frame 1–2. At its other end, aforesaid lath 13 is provided with a protrusion 15 which passes through a slot 16, provided for this purpose in the inner wall of each side member 1.

Each lath 13 furthermore boasts, in the vicinity of protrusions 9 and 10 of extension 6, two elevations, respectively 17 and 18, whereby said elevations each consist of two converging parts 19–20 and a plane top part 21.

Although in the drawings aforesaid protrusions 9 and 10 of extension 6, on the one hand, and protrusions 15 of laths 13, on the other hand, are shown as integral parts, it is obvious that they should preferably be fabricated in two parts in order to enable the assembly. For this purpose, a nut, or similar threaded element, shall be affixed to lath 13, or respectively under the frame of extension 6, which can cooperate with a pin, passing respectively through slots 11–12 or 16.

The operation of this extensible table is very simple and as follows.

In the position of normal use, see FIG. 1, the two half tops of the table 4 and 5 are located against each other, whereas the extension 6 is located under these two half table tops, or in other words, protrusions 9 and 10 fit in the bottom of slots 11 and 12, whereas elevations 17 and 18 of lath 13 fit against protrusions 9 and 10, so that the laths 13 are being maintained by these protrusions 9 and 10 of the extension.

In order to bring the table according to the invention from the position shown in FIG. 1 to the position shown in FIG. 13, it will be sufficient to slide out the two half table tops, see FIG. 7; subsequently to lift extension 6 slightly by hand to the position shown in FIG. 9, and finally to slide back the half table tops against the extension as shown in FIG. 13.

During the upward movement of extension 6; we obtain the action of aforesaid spring 14, that laths 13 are pulled foreward, and such to the position in which plane parts 21 of elevations 17 and 18 just fit under the protrusions 9 and 10 of the extension. We hereby obtain that the extension is maintained at the correct height and can no longer come down. The elevations 17–18 are maintained in this position, because spring 14 constantly pulls upon the lath 13 concerned, whereas protrusion 15 acts as a stop in slot 16.

In order to bring back the table from this position into the position of FIG. 1, it will be sufficient that protrusions 15 on each side of the table be pulled back, whereby the two laths 13 are being pulled back against spring 14, and whereby also the two elevations 17 and 18 are being pulled back, which automatically causes the extension to drop down. This extension 6 is of such a weight with respect to the pulling force of spring 14, that it is lowered slowly when lath 13 is pulled back, whereas the pulling forward of these laths is not possible without some extra aid.

It is thus quite obvious that a table with extension is thus obtained, which can more particularly be used for tables with glass tops, whereby the control mechanisms must be hidden and whereby a very simple contruction is obtained.

It is also obvious that this invention is by no means limited to the table described above as example and illustrated in the appended drawings, but that such a table, or respectively its control mechanism, can be built in many forms and dimensions without going beyond the scope of the invention.

What I claim is:

1. An extensible table construction including in combination:

a table frame having hollow side members each with two spaced vertical guide slots and with a horizontal guide slot in their inner surfaces;

two table end sections slidably mounted between said side members;

a vertically movable central leaf having two outwardly directed first protrusions on each of its sides, said protrusions being engaged in said vertical guide slots of said side members;

a pair of operating slides slidably mounted in respective ones of said side members and having at the location of each of said first protrusions thereof an elevated portion with two upwardly converging sides and a horizontal top part, said slide having at its one end a second protrusion engaged in said horizontal slot of the side member wherein the slide is slidably mounted;

a pair of springs each attached between said frame and another end of a respective one of said slides, said springs continuously urging said slides towards their operative position wherein said first protrusions are located on the top parts of said elevated parts of said slides, said second protrusions occupying end positions in said second guide slots and the upper faces of said end sections and of said leaf being located in the same plane, said operative position being reached when said slides are released to be displaced by said springs when said central leaf is lifted upwardly.

* * * * *